United States Patent [19]

Howerton et al.

[11] 4,368,656

[45] Jan. 18, 1983

[54] MANUAL TOOL FOR CUTTING POLYMERIC BELT BODY

[75] Inventors: Anderson W. Howerton, Nixa; Mark P. Foley, Springfield, both of Mo.

[73] Assignee: Dayco Corporation, Dayton, Ohio

[21] Appl. No.: 210,991

[22] Filed: Nov. 26, 1980

[51] Int. Cl.[3] ..... B26D 1/02

[52] U.S. Cl. ..... 83/178; 83/422; 83/425; 83/431; 83/436; 83/444; 83/448; 83/925 EB; 156/142

[58] Field of Search ..... 30/124, 280, 290; 83/178, 195, 33, 418, 422, 425, 425.2, 431, 436, 440, 444, 446–450, 925 R, 925 EB; 156/137, 142

[56] References Cited

U.S. PATENT DOCUMENTS

| | | | |
|---|---|---|---|
| 1,356,271 | 10/1920 | Dozier et al. | 83/436 |
| 1,881,020 | 10/1932 | McFarland | 83/441 |
| 3,103,319 | 9/1963 | Floyd et al. | 83/431 |
| 3,470,285 | 9/1969 | Kim et al. | 83/425.2 |
| 3,616,717 | 11/1971 | Jones | 83/925 R |
| 4,248,110 | 2/1981 | Spivy | 83/925 EB |

FOREIGN PATENT DOCUMENTS

| | | | |
|---|---|---|---|
| 863760 | 4/1941 | France | 83/425 |

*Primary Examiner*—Stephen G. Kunin
*Assistant Examiner*—K. Bradford Adolphson
*Attorney, Agent, or Firm*—Joseph V. Tassone

[57] ABSTRACT

A manual tool for cutting a polymeric endless power transmission belt body is provided wherein the belt body has a plurality of endless V-belt elements fastened in spaced side-by-side relation by a common endless structure to define alternating projections and grooves in the belt body and wherein the tool comprises, a cutting knife for cutting the endless structure to define a plurality of endless belts each having at least one belt element, a support which is adapted to be disposed in a stationary position and has the cutting knife fastened thereon at a fixed location, and apparatus for supporting and guiding the belt body during cutting with the supporting and guiding apparatus being supported on the support and with the knife cooperating with the supporting and guiding apparatus to provide precise cutting through the structure at the base of a particular groove upon moving the belt body relative to the knife with the knife in cutting engagement with the structure.

12 Claims, 9 Drawing Figures

MANUAL TOOL FOR CUTTING POLYMERIC BELT BODY

BACKGROUND OF THE INVENTION

1. Field of the Invention

This invention relates to a manual tool for cutting a polymeric endless power transmission belt body which has a plurality of endless V-belt elements by cutting between immediately adjacent elements to define a plurality of endless belts each having at least one belt element and to a method of cutting with such a tool.

2. Prior Art Statement

Endless power transmission belts made primarily of polymeric material are widely used in industry and there are many types of such belts including, for example, belts consisting of a single belt element and belts consisting of a plurality of belt elements which are fastened together as a unitary structure in spaced side-by-side relation and referred to as multiple-element belts. These multiple-element belts are of two main types, i.e., ribbed belts and banded belts.

However, regardless of whether such polymeric belts are of the single element or multiple element type, they are usually cut from belt sleeves each having a large number of belt elements; and, numerous power driven belt cutting machines are known in the art and used to cut such belt sleeves.

Multiple elements belts, such as banded belts, are used in applications where it is necessary to transmit large loads or forces and often require a plurality of from two to six elements in a particular banded belt. However, it is costly for a local operator, such as a warehouse operator, belt distributor, or field user to provide an inventory of banded belts of each size and having two, three, four, five, and six belt elements. Accordingly, it would be desirable to stock each particular size of banded belts which is used most often in its maximum number of available belt elements and then cut same to define a banded belt having the required lesser number of elements for a specific application.

As indicated above, power driven belt cutting machines for cutting belt sleeves are known and could be used by a local operator to provide the above-described cutting. Similarly, power driven machines of various types have also been proposed for cutting multiple element banded belts. However, such machines are expensive and basically impractical for a local operator.

Accordingly, efforts have been made to cut a banded belt using a simple hand-held cutting knife. However, the results obtained using such a knife are at best marginal, due to the difficulty in cutting and handling a banded belt body which has a large number of belt elements. For example, a six element banded belt of large capacity may weigh as much as several hundred pounds. Also, once such a belt is cut, it is difficult to trim the excess belt material between the belt elements with any degree of precision so as to assure proper operation of the belt in associated sheaves.

SUMMARY

It is a feature of this invention to provide an improved manual tool for cutting a polymeric endless power transmission belt body which has a plurality of endless V-belt elements fastened in spaced side-by-side relation by a common endless structure to define alternating projections and grooves in the belt body and wherein the tool comprises a cutting knife for cutting the endless structure to define a plurality of endless belts each having at least one belt element.

For example, one embodiment of this invention comprises, a support which is adapted to be disposed in a stationary position, means for fastening the knife at a fixed location on the support, and means for supporting and guiding the belt body during cutting with the supporting and guiding means being supported on the support and with the knife cooperating with the supporting and guiding means to provide precise cutting through the structure at the base of a particular groove upon moving the belt body relative to the knife with the knife in cutting engagement with the structure.

Therefore, it is an object of this invention to provide an improved manual tool for cutting a polymeric endless power transmission belt body of the character mentioned having one or more of the novel features set forth above or hereinafter shown or described.

Other details, features, uses, objects, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DETAILED DESCRIPTION

Figure 1:
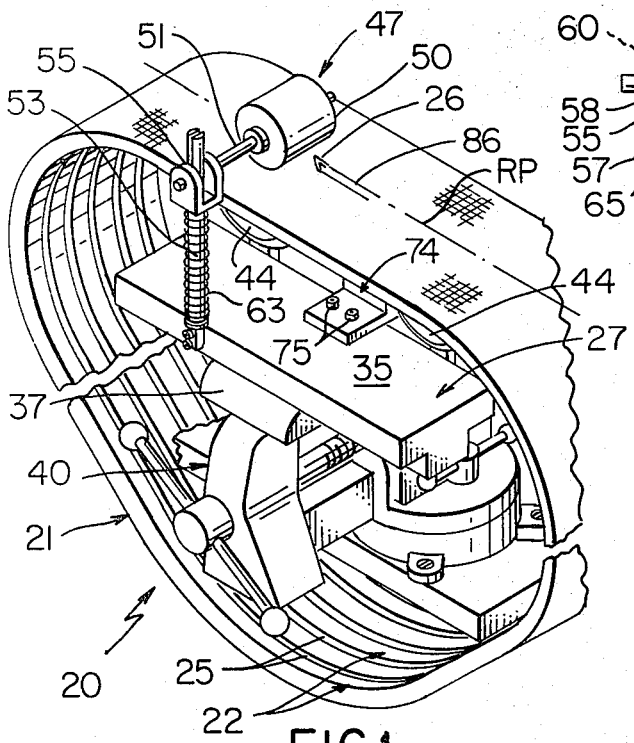
FIG. 1 is an isometric view with parts broken away particularly illustrating one exemplary embodiment of the tool of this invention for cutting a belt body and method of cutting utilizing such tool.
Figure 3:
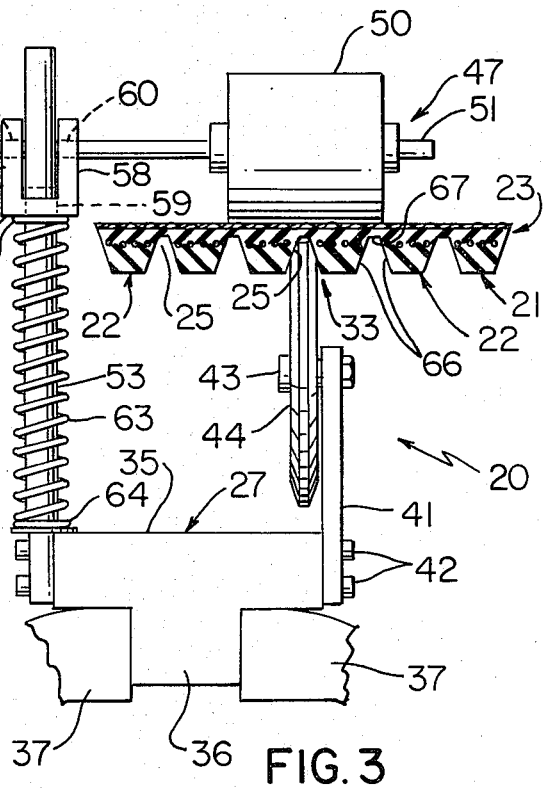
FIG. 3 is a view taken essentially on the line 3—3 of FIG. 2 with parts in cross section and parts broken away.
Figure 2:
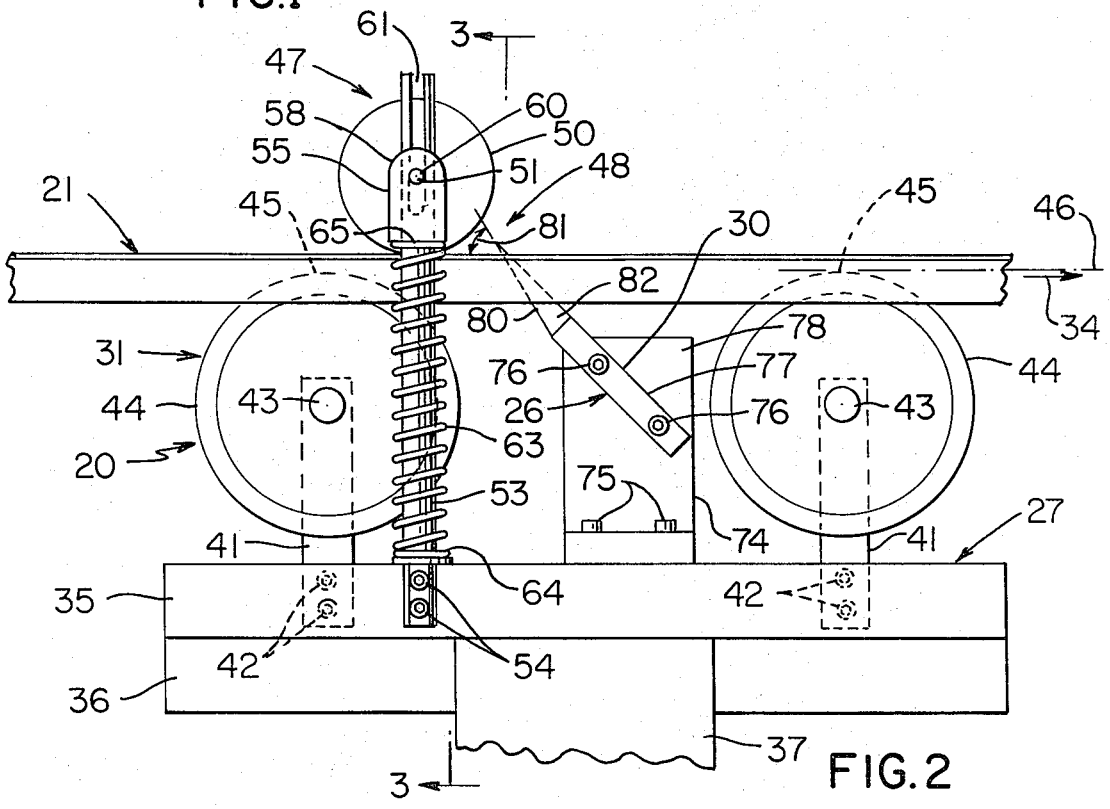
FIG. 2 is a side view of the tool of FIG. 1 showing only the top portion of the belt body during cutting thereof.

Reference is now made to FIGS. 1—3 of the drawings which illustrate one exemplary embodiment of a hand-operated or manual tool of this invention and such tool is designated generally by the reference numeral 20. The tool 20 is particularly adapted for cutting a polymeric endless power transmission belt body 21 made primarily of polymeric material whereby such belt body will also be referred to as a polymeric belt body and the endless configuration of the belt body will be readily apparent from FIG. 1.

The belt body 21 is a banded belt body and has a plurality of substantially identical endless V-belt elements (FIG. 3) each designated by the same reference numeral 22 with only a representative few of such elements being thus designated; and, the elements 22 are fastened in spaced side-by-side relation by a common endless structure or tie band which will be designated generally by the reference numeral 23. The tie band 23 is provided as an integral part of the belt body; and, as is known in the art, ties the elements 22 together as a unitary structure and thereby defines alternating projections and grooves 25 in the belt body with the projections also being designated by the reference numeral 22 whereby the belt elements will be referred to interchangeably as projections 22 or belt elements 22.

The tool 20 comprises a cutting knife 26 for cutting the endless structure 23 to define a plurality of endless belts each having at least one belt element and a support which is designated by generally by the reference numeral 27. The support 27 is adapted to be supported in a stationary position and the tool 20 has means 30 for fastening the knife 26 at a fixed location on the support 27. The tool 20 also has means designated generally by the reference numeral 31 for supporting and guiding the belt body 21 during cutting; and, the means 30 and 31 will be described in more detail subsequently.

The supporting and guiding means 31 is supported on the support 27; and, the knife 26 cooperates with such supporting and guiding means to provide precise cutting through the tie band or structure 23 at the base of a particular groove upon moving the belt body 21 relative to the knife 26 with the knife in cutting engagement with such tie band. In particular, and as illustrated in FIG. 3, for example, with the knife in cutting engagement and extending through the tie band 23 of the central groove 25 of the belt body 21, as illustrated at 33, the belt body is supported by the supporting and guiding means 31 and a belt body moving force 34 is applied as indicated by the arrow in FIG. 2. The moving force 34 is applied by manually grasping the belt body on opposite side edge portions thereof and physically pulling same with the cutting knife 26 in cutting engagement whereby a simple and precise cutting is achieved.

The support 27 has a T-shaped configuration when viewed from an end thereof or when viewed on a corresponding cross section whereby such support has an arm 35 which is adapted to be supported horizontally and a depending leg 36 extending from the central part of arm 35. The leg 36 and hence support 27 is adapted to be supported in a stationary position and preferably by grasping the opposed side surfaces of leg 36 between the jaws 37 of a standard vise 40. The vise 40 may be of any known type and is usually a standard piece of equipment for a local operator. It will also be appreciated that the support 27 may have suitable openings or other means therein enabling attaching same at any desired stationary or fixed position.

As previously indicated the tool 20 has means 31 for supporting and guiding the belt body 21 during cutting; and, in this example of the invention such means comprises a pair of vertical members or support posts 41 which are detachably fastened to and thus supported by the arm 35 of support 27 using threaded bolts 42 and each post 41 has a support shaft 43 at the upper end thereof. The supporting and guiding means 31 also comprises a pair of members in the form of a pair of freely rotatable wheels 44 which are disposed substantially in a rectilinear path RP (FIG. 1) with the knife 26 and aligned therebetween. The wheels 44 are supported for rotation on their associated shafts 43 and are disposed such that the top surfaces 45 thereof are disposed substantially in a horizontal plane 46, as shown by dot-dash lines in FIG. 2. The wheels 44 are adapted to receive and support the belt body 21 thereon and provide a precise guiding action by meshing within an associated groove 25 of the belt body, and as will be described subsequently.

The tool 20 also has urging means 47 for urging the belt body 21 toward the horizontal plane 46 and thus toward the cutting knife 26. Further, the disposal or placement of such cutting knife 26 is such that with the cutting knife in its normal position the outer tip thereof extends outwardly through the top surface of the belt body 21 being cut and as shown at 48 in FIG. 2.

The urging means 47 comprises a freely rotatable roller 50 which is rotatably supported on a support shaft 51 and the roller 50 and support shaft 51 are supported for vertical movements toward and away from the horizontal plane 46 by an assembly which is comprised of a support column 53 detachably fastened to the arm 35 of the support 27 by threaded bolts 54 and a clevis 55 which is slideable vertically along the column 53. The clevis 55 has a lower portion 57 and a pair of upstanding arms 58 fastened to the lower portion 57 and extending vertically along opposite sides of column 53. The lower portion 57 has a central opening 59 which receives the column 53 therethrough and such opening 59 has an axis disposed parallel to and between the arms 58 whereby the clevis is free to slide up and down along the column 53 as mentioned above.

The clevis has a pair of aligned openings 60 through the upper portions of its arms 58. The openings 60 receive an end portion of the support shaft therethrough and thus serve to attach such shaft 51 and roller 50 to the clevis 55. The support column 53 has a diametral slot 61 extending vertically through its upper portion and such slot is adapted to receive a portion of the support shaft 51 which extends between the clevis arms 58 once the shaft 51 is fixed to the clevis 55.

The urging means 47 also comprises spring means in the form of a tension spring 63 which has its lower end 64 fixed to the transverse portion 35 of support 27 and its upper end 65 fixed to the transverse portion 57 of the clevis 55. The tension spring 63 serves to pull or urge the clevis 55, support shaft 51, and roller 50 downwardly thereby urging the roller 50 against the top surface of the belt body and the belt body 21 toward the horizontal plane 46 and the cutting knife 26.

The urging means 47 is of optimum simplicity and uses spring 63 to provide a yielding urging action. Further, the belt body 21 may be simply placed in position to be cut by overriding spring 63 by pulling the roller 50 to the dotted line position shown in FIG. 4 and then slowly allowing the spring 63 to pull the roller 50 against the top surface of the belt body 21.

The belt body 21 is a body of a standard banded belt wherein the belt elements 22 thereof are held together by the usual tie band 23 and such tie band may be of any construction known in the art. Further, each groove 25 defined in the belt body 21 between immediately adjacent elements 22 is of basically standard cross-sectional configuration (FIG. 3). Accordingly, each groove 25 has side walls defined by facing surfaces each designated by the same reference numeral 66 and an interconnecting surface 67 defines the base of such groove. The facing surfaces 66 are symmetrical inclined surfaces which are adapted to engage associated walls or surfaces of a standard sheave and thus are inclined so that each pair of surfaces 66 has a nominal included angle of 40° therebetween.

Figure 9:
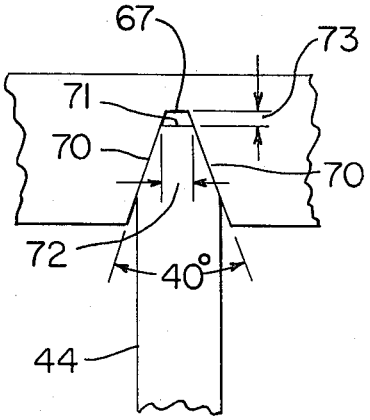
FIG. 9 is an enlarged view particularly illustrating the guiding action provided by supporting and guiding means of the tool during cutting.

Each of the wheels 44 comprising the supporting and guiding means 31 has an outer annular portion of trapezoidal cross-sectional configuration and as shown in FIG. 9. The trapezoidal configuration is defined by symmetrical nonparallel sides 70 having an included angle therebetween of 40°. The smaller of the parallel sides is designated by the reference numeral 71 and defines the periphery of its associated wheel; and, the smaller of the parallel sides has a dimension 72 which is greater than the corresponding width of the surface 67 which defines the base of each groove 25. This construction, arrangement, and dimensioning of parts assures that the belt body at the base of each groove 25 is spaced away from its associated wheel 44 by a distance or spacing 73. This spacing 73 assures that each wheel 44 will not engage or bottom out against the surface 67 whereby a precise guiding or tracking is provided by the wheels 44 as the belt body 21 is cut.

Figure 4:
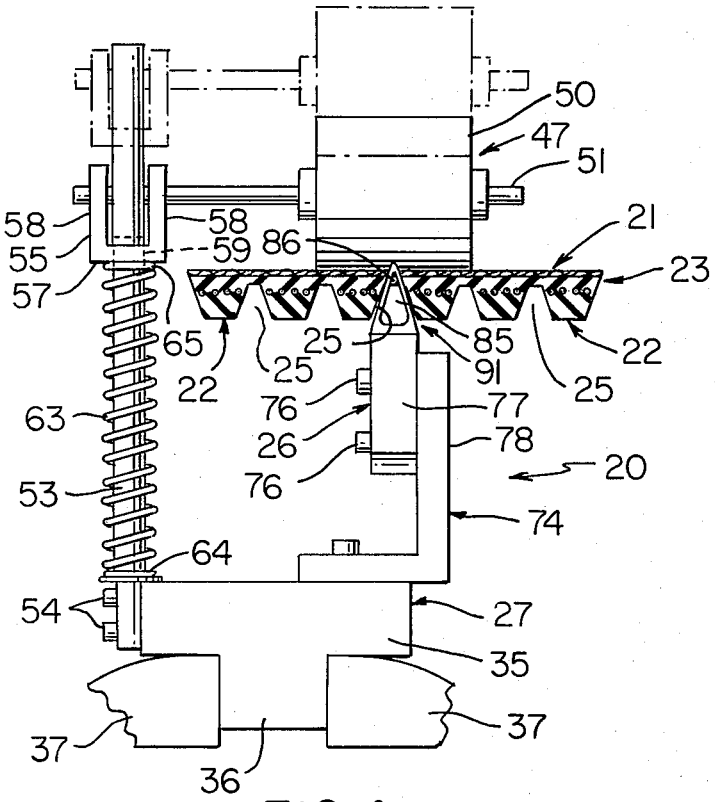
FIG. 4 is a view similar to FIG. 3 and particularly illustrating the cutting knife of the tool in cutting position and the action of a roller urging the belt body toward the cutting knife.

As best shown in FIGS. 2 and 4, the knife 26 has means 30 for fastening same on the support 27 and such fastening means 30 comprises an L-shaped bracket 74 which is detachably fastened to the transverse arm 35 of support 27 by a pair of threaded bolts 75. The fastening means also comprises a pair of threaded bolts 76 which extend through the inner portion 77 of the fastening knife and are threadedly received within the upstanding arm 78 of the L-shaped bracket 74.

The knife 26 has cutting edge means in the form of a pair of straight cutting edges 80 (FIGS. 2 and 5) disposed at an acute angle with the horizontal plane 46 and in this example of the invention the cutting edges 80 are disposed at an acute angle 81 of approximately 45° with such horizontal plane. The cutting edges 80 are disposed to face in a direction opposite from the direction of movement of the belt body 21 during cutting. Thus, with the edges 80 in cutting engagement and upon manually pulling the belt body 21 by applying the moving force 34 the inclined cutting edges 80 cause the belt body 21 and tie band 23 to move downwardly toward the base 82 of each cutting edge 80 thereby assuring efficient cutting.

The knife 26 is what is popularly referred to as a hollow ground knife and the cutting edges 80 are straight cutting edges which have outer ends 84. The cutting edges are disposed to converge so that the outer ends 84 are adjacent each other and define a hollow roughly triangular space 85 therebetween. The cutting edges 80 serve the dual purpose of cutting through the structure or tie band 23 and separating a strip 86 of the tie band 23 (FIG. 1) which is disposed between the edges 80.

The cutting edges 80 of the cutting knife 26 illustrated in FIGS. 2 and 4–6 are disposed substantially in a V-shaped pattern with the outer ends in adjoining relation. Each cutting edge 80 is defined by an outer knife wall 87 (FIG. 6) disposed substantially parallel to the rectilinear path RP and a cooperating inner knife wall 88 disposed at an angle to such rectilinear path. Each pair of walls 87-88 terminates in an associated cutting edge 80.

Figure 5:
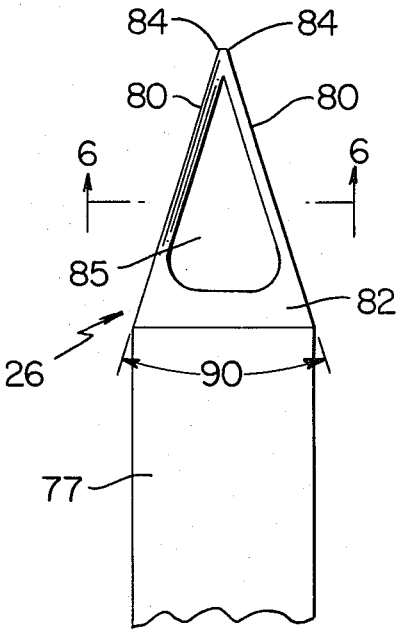
FIG. 5 is an enlarged view of the cutting knife of FIG. 4.

The cutting edges 80 of the knife 26 are disposed to define an included angle 90 therebetween which has a nominal angular dimension of 36°, as shown in FIG. 5. With this 36° angle between the cutting edges 80 the knife may be readily extended through the tie band 23 so as to provide cuts at the base of a particular groove 25 with optimum efficiency and with minimum tendency for the cutting edges 80 to engage the walls 66 of immediately adjacent belt elements 22 defining a particular groove 25 and as shown at 91 in FIG. 4, for example. Accordingly, the cutting action is such that as the tie band of a belt body 21 is cut a strip 86 is severed and moved in the hollow space 85. This cutting action amounts to a precise and simultaneous cutting of the belt body 21 and trimming of one side edge of the pair of banded belts thus defined.

Figure 7:
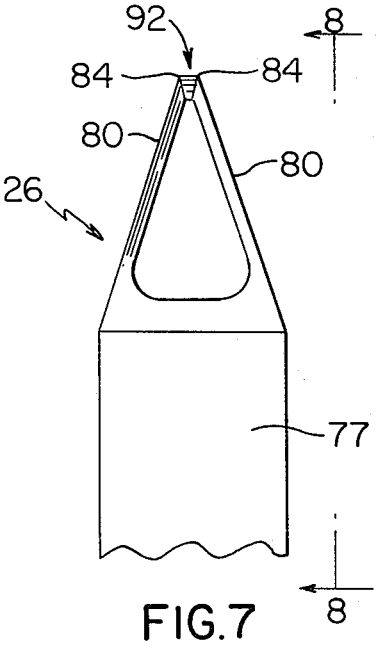
FIG. 7 is a view similar to FIG. 5 illustrating another exemplary embodiment of a cutting knife which may comprise the tool of this invention.
Figure 8:
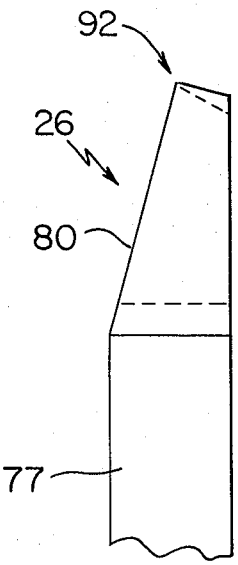
FIG. 8 is a side view of the cutting knife of FIG. 7 taken essentially on the line 8—8 of FIG. 7.
Figure 6:
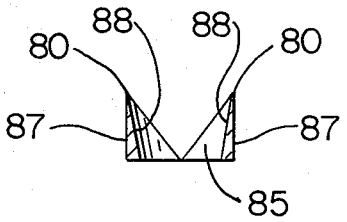
FIG. 6 is a cross-sectional view taken essentially on the line 6—6 of FIG. 5.

The cutting knife 26 has cutting edges 80 which are disposed in a substantially V-shaped pattern or configuration with outer walls 84 in adjoining relation as shown in FIG. 5 and as previously described. A modification of a cutting knife is illustrated in FIGS. 7 and 8 and also designated by the reference numeral 26. In this modification the cutting edges 80 are also disposed in a basically converging manner; however, the outer ends 84 thereof are disposed in spaced relation as shown at 92 in FIG. 7 to define a roughly U-shaped configuration. The cutting edges 80 of this modification are also disposed with an included angle of 36° therebetween.

The knife 26 of FIGS. 7 and 8 is used in applications where the belt body 21 has belt elements 22 of a larger size. The spaced relation shown at 92 in the outer ends of the cutting edges of the knife of FIGS. 7 and 8 accommodates the larger width of each portion of a tie band being cut at the base of a groove 25.

It will also be appreciated that in cutting banded belts in which the pitch between immediately adjacent belt elements 22 is very small, a knife 26 which has a single cutting edge is provided. Accordingly, the resulting cut is a single cut or slit inasmuch as there is very little or no material to be trimmed or removed at the base of a groove of such a banded belt of small pitch between belt elements.

In the above description the tool 20 has been described as being used to cut multiple element belts in the form of banded belts; however, it will be appreciated that such tool may be utilized to cut other belt bodies having a plurality of belt elements including so-called ribbed belts, double v-ribbed belts, and the like. Also, if desired, a multiple element belt may be cut by the tool 20 to define a single element V-belt.

The method of this invention is achieved using a simple hand operated or manual tool and comprises simple steps to provide efficient cutting of an endless structure of a multiple element belt body with a cutting knife to define a plurality of endless belts each having at least one belt element. The method comprises the steps of disposing a support in a stationary position, fastening a cutting knife at a fixed location on the support, providing means for supporting and guiding the belt body on the support, and moving the belt body relative to the knife with the knife in cutting engagement with the structure. During the moving step the knife cooperates with the supporting and guiding means to provide precise cutting through the structure at the base of a particular groove. It will be appreciated that the cutting action is started simply by forcing the outer end of the cutting knife through the tie band 23 at the base of a particular groove and then proceeding with the cutting action as described above.

The wheels 44 and roller 50 of tool 20 may be made of any suitable material known in the art. For example, such components 44 and 55 may be made of metallic material, non-metallic material, or a combination of metallic and non-metallic material.

The cutting knife 26 may also be made of any suitable material used in making knifes of this type. Further, each knife may be readily sharpened using sharpening techniques known in the art.

While present exemplary embodiments of this invention, and methods of practicing the same, have been illustrated and described, it will be recognized that this invention may be otherwise variously embodied and practiced within the scope of the following claims.

What is claimed is:

1. In a manual tool for cutting a polymeric endless power transmission belt body which has a plurality of endless V-belt elements fastened in spaced side-by-side relation by an endless structure to define alternating projections and grooves in said belt body, said tool comprising, a cutting knife for cutting said endless structure to define a plurality of endless belts each having at least one belt element, the improvement comprising a support which is adapted to be disposed in a stationary position, means for fastening said knife at a fixed location on said support, and means for supporting and guiding said belt body during cutting, said supporting and guiding means being supported on said support, said knife cooperating with said supporting and guiding means to provide precise cutting through said structure at the base of a particular groove upon moving said belt body relative to said knife with said knife in cutting engagement with said structure, said supporting and guiding means comprising a pair of rotatable wheels disposed substantially in a rectilinear path with said knife and with said knife aligned therebetween, each of said wheels having an outer portion disposed in said particular groove together with said knife during cutting, said outer portions defining the sole means which engage said belt body to provide supporting and guiding during said cutting, said particular groove having side walls defined by facing surfaces of an immediately adjacent pair of belt elements and said outer portions of said wheels only engaging said facing surfaces of said adjacent pair of belt elements and being spaced from said endless structure during said cutting.

2. A tool as set forth in claim 1 in which said wheels are supported for rotation in a common vertical plane with the top surfaces thereof disposed substantially in a horizontal plane and further comprising means urging said belt body toward said horizontal plane.

3. A tool as set forth in claim 2, in which said means urging said belt body toward said horizontal plane comprises a freely rotatable roller supported for movement toward and away from said horizontal plane and spring means for yieldingly urging said roller and belt body toward said horizontal plane.

4. A tool as set forth in claim 3 in which said knife has cutting edge means disposed to face in a direction opposite from the direction of movement of said belt body, said cutting edge means being inclined at an acute included angle with said structure of said belt body that is disposed between said wheels while intersecting same on opposite sides thereof thereby causing said belt body and structure to feed downwardly toward the base of said cutting edge means upon moving of said belt body relative to said knife with said knife in said cutting engagement.

5. In a manual tool for cutting a polymeric endless power transmission belt body which has a plurality of endless V-belt elements fastened in spaced side-by-side relation by an endless structure to define alternating projections and grooves in said belt body, said tool comprising, a cutting knife for cutting said endless structure to define a plurality of endless belts each having at least one belt element, the improvement comprising a support which is adapted to be disposed in a stationary position, means for fastening said knife at a fixed location on said support, and means for supporting and guiding said belt body during cutting, said supporting and guiding means being supported on said support, said knife cooperating with said supporting and guiding means to provide precise cutting through said structure at the base of a particular groove upon moving said belt body relative to said knife with said knife in cutting engagement with said structure, said supporting and guiding means comprising a pair of members disposed substantially in a rectilinear path with said knife and with said knife aligned therebetween, each of said pair of members having an outer portion disposed in said particular groove together with said knife during cutting, said outer portions defining the sole means which engage said belt body to provide supporting and guiding during said cutting, said particular groove having side walls defined by facing surfaces of an immediately adjacent pair of belt elements and said pair of members comprising a pair of freely rotatable wheels, said wheels being supported for rotation in a common vertical plane with the top surfaces thereof disposed substantially in a horizontal plane and further comprising means urging said belt body toward said horizontal plane, said means urging said belt body toward said horizontal plane comprising a freely rotatable roller supported for movement toward and away from said horizontal plane and spring means for yieldingly urging said roller and belt body toward said horizontal plane, said knife having cutting edge means disposed to face in a direction opposite from the direction of movement of said belt body, said cutting edge means being inclined at an acute included angle with said horizontal plane while intersecting same on opposite sides thereof thereby causing said belt body and structure to feed downwardly toward the base of said cutting edge means upon moving of said belt body relative to said knife with said knife in said cutting engagement.

6. A tool as set forth in claim 5 in which said knife is a hollow ground knife wherein said cutting edge means comprises a pair of straight cutting edges having outer ends, said cutting edges being disposed to converge so that said outer ends are adjacent each other with a hollow roughly triangular space therebetween, said cutting edges serving the dual purpose of cutting through said endless structure and separating a strip of said structure disposed between said edges from the remainder of said structure.

7. A tool as set forth in claim 6 in which said cutting edges are disposed in a substantially V-shaped pattern with said outer ends in adjoining relation.

8. A tool as set forth in claim 6 in which said cutting edges are disposed in a roughly U-shaped pattern with said outer ends in spaced relation.

9. A tool as set forth in claim 6 in which said facing surfaces are inclined surfaces which diverge from said structure and are adapted to engage walls of a standard sheave and thus have a nominal included angle therebetween of 40° and said converging straight cutting edges of said knife are disposed to define an included angle therebetween of 36°.

10. A tool as set forth in claim 9 in which each of said pair of wheels has an outer annular portion defining said outer portion thereof, each outer annular portion being of trapezoidal cross-sectional configuration defined by symmetrical non-parallel sides intersected at opposite ends thereof by a longer and a shorter parallel side, said non-parallel sides having an included angle of 40° therebetween and said shorter of said parallel sides comprising the peripheral surface of the wheel, said shorter parallel side having a dimension which is greater than the width of a bottom wall of said particular groove which defines said base thereof thereby assuring the peripheral surface of each wheel is spaced away from said bottom wall whereby said belt body is moved with precision upon moving same relative to said knife.

11. A tool as set forth in claim 6 in which said pair of straight cutting edges are inclined at said acute angle of approximately 45° with said horizontal plane.

12. A tool as set forth in claim 11 in which each of said cutting edges is defined by an outer surface disposed parallel to said rectilinear path and an inner surface disposed at an angle to said outer surface.

* * * * *